US007173576B2

(12) United States Patent
O'Neill, Jr. et al.

(10) Patent No.: US 7,173,576 B2
(45) Date of Patent: Feb. 6, 2007

(54) HANDSET QUADRIFILAR HELICAL ANTENNA MECHANICAL STRUCTURES

(75) Inventors: Gregory A. O'Neill, Jr., Rockledge, FL (US); Young-Min Jo, Viera, FL (US); Paul A. Tornatta, Jr., Melbourne, FL (US); John Charles Farrar, Indialantic, FL (US); Murray Fugate, Coral Springs, FL (US); Ki-Chul Kim, Suwon (KR); Joon-Wan Lee, Seoul (KR)

(73) Assignee: SkyCross, Inc., Viera, FL (US)

( * ) Notice: Subject to any disclaimer, the term of this patent is extended or adjusted under 35 U.S.C. 154(b) by 0 days.

(21) Appl. No.: 11/130,035

(22) Filed: May 16, 2005

(65) Prior Publication Data

US 2006/0022892 A1 Feb. 2, 2006

Related U.S. Application Data

(63) Continuation-in-part of application No. 10/998,301, filed on Nov. 26, 2004.

(60) Provisional application No. 60/592,011, filed on Jul. 28, 2004.

(51) Int. Cl.
*H01Q 1/36* (2006.01)

(52) U.S. Cl. ..... 343/895; 343/702

(58) Field of Classification Search ..... 343/795, 343/850, 796, 853, 702
See application file for complete search history.

(56) References Cited

U.S. PATENT DOCUMENTS 5,896,113 A 4/1999 O'Neill, Jr.
5,909,196 A 6/1999 O'Neill, Jr.
5,920,292 A 7/1999 O'Neill, Jr.
5,990,847 A 11/1999 Filipovic et al.
6,052,089 A 4/2000 Eggleston
6,054,966 A 4/2000 Haapala
6,094,178 A 7/2000 Sanford
6,212,413 B1 4/2001 Kiesi
6,229,499 B1 * 5/2001 Licul et al. ..... 343/895
6,232,929 B1 5/2001 Ermutlu et al.
6,278,415 B1 8/2001 Matsuyoshi et al.
6,288,686 B1 9/2001 Josypenko
6,320,549 B1 11/2001 Nybeck et al.
6,384,798 B1 * 5/2002 Barta et al. ..... 343/895

(Continued)

OTHER PUBLICATIONS

Kilgus, C. C.; "Multielement Fractional Turn Helices"; IEEE Transactions on Antennas and Propagation; Jul. 1968; pp. 499-500.
Kilgus, C.C.; "Resonant Quadrafilar Helix"; IEEE Transactions on Antennas and Propagation, vol. AP-17: May 1969; pp. 349-351.
Kilgus, Dr. Charles C.; "Spacecraft and Ground Station Applications of the Resonant Quadrifilar Helix"; Digest of the 1974 Int. IEEE/Ap-5 Symposium; Jun. 1974; pp. 75-77.

(Continued)

*Primary Examiner*—Trinh Vo Dinh
(74) *Attorney, Agent, or Firm*—John L. DeAngelis; Beusse, Wolter, Sanks, Mora & Maire, P.A.

(57) ABSTRACT

A quadrifilar helical antenna comprising two pairs of filars having unequal lengths and phase quadrature signals propagating thereon. A disk-like impedance matching element disposed at a lower end of the antenna matches a source impedance to an antenna impedance. In certain embodiments a first crossbar connector on a substrate disposed at an upper end of the antenna electrically connects two helical filars to form a first filar pair and a second crossbar connector disposed on the substrate connects two filars to form a second filar pair.

37 Claims, 10 Drawing Sheets

U.S. PATENT DOCUMENTS

| | | | |
|---|---|---|---|
| 6,407,720 | B1 | 6/2002 | Josypenko |
| 6,424,316 | B1 | 7/2002 | Leisten |
| 6,480,173 | B1 | 11/2002 | Marino |
| 6,483,471 | B1 | 11/2002 | Petros |
| 6,535,179 | B1 | 3/2003 | Petros |
| 6,545,649 | B1 | 4/2003 | Seavey |
| 6,608,604 | B1 | 8/2003 | Sharaiha et al. |
| 6,621,458 | B1 | 9/2003 | Petros et al. |
| 6,624,795 | B2 | 9/2003 | Boyle |
| 6,653,987 | B1 | 11/2003 | Lamensdorf et al. |
| 6,720,929 | B2 | 4/2004 | Nybeck et al. |
| 2003/0016184 | A1* | 1/2003 | Kitching et al. ..... 343/895 |

OTHER PUBLICATIONS

Kilgus, Chares C.; "Shaped-Conical Radiation Pattern Performance of the Backfire Quadrifilar Helix"; IEEE Transactions on Antennas and Propagation; May 1975; pp. 392-397.

Ruperto, Eugene F.; "If your existing VHF Omnidirectional antenna coverage is "just okay", this twisted 'tenna is probably just what you need!"; date unknown; pp. 1-9.

Marini, Domenico; "Experimental Investigation of Quadrifilar Helix Antennas for 2400 MHz"; The AMSAT Journal May/Jun. 2004; pp. 6-10.

* cited by examiner

HANDSET QUADRIFILAR HELICAL ANTENNA MECHANICAL STRUCTURES

CROSS-REFERENCE TO RELATED APPLICATIONS

This patent application is a continuation-in-part application claiming the benefit of the patent application assigned Ser. No. 10/998,301 filed on Nov. 26, 2004 and entitled Quadrifilar Helical Antenna, which claims the benefit of the provisional patent application assigned Ser. No. 60/592,011 filed on Jul. 28, 2004.

FIELD OF THE INVENTION

The present invention relates to an antenna for use in a satellite communications link, and in particular to a quadrifilar helical antenna (QHA) for use in a satellite communications link.

BACKGROUND OF THE INVENTION

A helical antenna comprises one or more elongated conductive elements wound in the form of a screw thread to form a helix. The geometrical helical configuration includes electrically conducting elements of length L arranged at a pitch angle P about a cylinder of diameter D. The pitch angle is defined as an angle formed by a line tangent to the helical conductor and a plane perpendicular to a helical axis. Antenna operating characteristics are determined by the helix geometrical attributes, the number and interconnections between the conductive elements, and the feed arrangement. When operating in an end fire or forward radiating axial mode the radiation pattern comprises a single major pattern lobe. The pitch angle determines the position of maximum intensity within the lobe. Low pitch angle helical antennas tend to have the maximum intensity region along the axis; for higher pitch angles the maximum intensity region is off-axis.

Quadrifilar helical antennas (QHA) are used for communication and navigation receivers operating in the UHF, L and S frequency bands. A resonant QHA with limited bandwidth is also used for receiving GPS signals. The QHA has a relatively small size, excellent circular polarization coverage and a low axial ratio over most of the upper hemisphere field of view. Since the QHA is a resonant antenna, its dimensions are typically selected to provide optimal performance for a narrow frequency band. C. C. Kilgus first described the QHA in "Resonant Quadrifilar Helix," IEEE Transactions on Antennas and Propagation, Vol. AP-17, May 1969, pp. 349–351.

One prior art quadrifilar helical antenna comprises four equal length filars mounted on a helix having a diameter of about 30 mm for operation at about 1575 MHz. Given these geometrical features, the antenna presents a driving point impedance of about 50 ohms, which is suitable for matching to a common 50 ohm characteristic impedance coaxial cable. The four filars of the QHA are fed in phase quadrature, i.e., a 90 degrees phase relationship between adjacent filars. There are at least two known prior art techniques for quadrature feeding of the four equal-length QHA filars. One such quadrature matching structure employs a lumped or distributed branch line hybrid coupler (BLHC) and a terminating load, together with two lumped or distributed baluns. Another technique that offers a somewhat broader bandwidth uses three branch line hybrid couplers (a first input BLHC receiving the input signal and providing an output signal to two parallel BLHC'S) each operative with a terminating load. A quarter wave phase shifter provides a 90 degrees phase shift between the first BLHC and one of the parallel-connected BLHC'S.

It is known that such quadrature matching techniques, such as hybrid couplers and baluns, disadvantageously increase the size of the printed circuit board on which the antenna is mounted. The couplers and baluns also increase the antenna cost, and each additional component operative with the antenna imposes losses and bandwidth limitations.

Typically, the QHA is a self-sufficient radiating structure operated without a ground plane or counterpoise. However, when the QHA is installed in close proximity to a radio transceiver handset, the handset structure can induce electromagnetic wave reflections that influence the QHA's radiation pattern and impedance, much like a ground plane. For example, if the QHA emits a right-hand circularly polarized signal, upon reflection from a conducting surface, the signal is transformed to a left-hand circularly polarized signal. Obviously, such effects negatively influence the antenna's performance, and can be particularly troublesome if the communications system employs dual signal polarizations.

BRIEF SUMMARY OF THE INVENTION

According to one embodiment of the invention, a quadrifilar helical antenna, comprises a substantially cylindrical substrate; a first pair of serially connected helical filars having a first length and disposed on the substrate, the first pair of filars having a first end and a second end; a second pair of serially connected helical filars having a second length different than the first length and disposed on the substrate, the second pair of filars having a third and a fourth end and an impedance matching element conductively connected to the first, the second, the third and the fourth ends for matching an antenna impedance to a source impedance.

According to another embodiment of the invention, a handset communications device comprises a base; a cover movably engaged with the base for manipulation into different orientations with respect to the base and a quadrifilar helical antenna disposed in the base. The antenna comprises a substantially cylindrical substrate; a first, a second, a third and a fourth helical filar disposed on the substrate, wherein at least two of the first, the second, the third and the fourth filars have a different length; an impedance matching element conductively connected to the first, second, third and fourth filars for matching an antenna impedance to a source impedance and a connector disposed between the impedance matching element and the base.

BRIEF DESCRIPTION OF THE DRAWINGS

The foregoing and other features of the present invention will be apparent from the following more particular description of the invention as illustrated in the accompanying drawings, in which like reference characters refer to the same parts throughout the different figures. The drawings are not necessarily to scale, emphasis instead being placed upon illustrating the principles of the invention.

DESCRIPTION OF THE INVENTION

Figure 1:
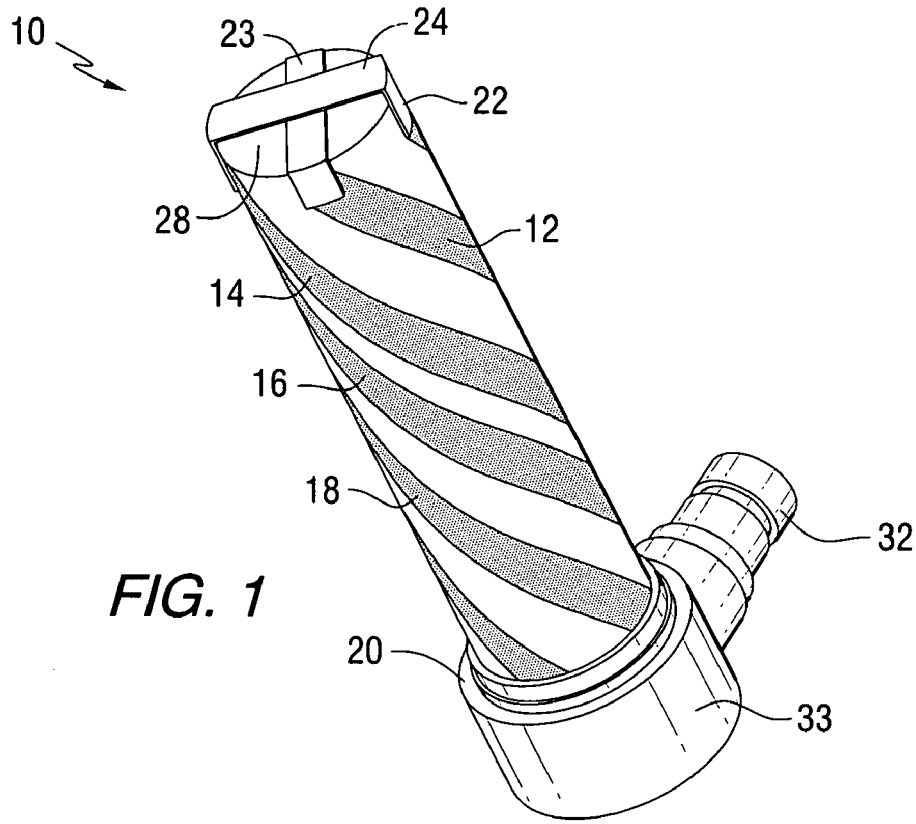
FIGS. 1 and 2 illustrate different views of a QHA according to the teachings of the present invention.

Before describing in detail the particular antenna apparatus and a method for making the antenna according to the present invention, it should be observed that the present invention resides in a novel and non-obvious combination of hardware elements and process steps. Accordingly, these elements have been represented by conventional elements in the drawings and specification, wherein elements and method steps conventionally known in the art are described in lesser detail, and elements and steps pertinent to understanding the invention are described in greater detail.

This invention relates to an antenna responsive to a signal source supplying quadrature related currents to each of four filars, comprising a short pair of filars and a long pair of filars. The antenna further employs a simple, low cost, low loss matching element that takes advantage of the circularly polarized gain provided by the antenna filars. In one embodiment the antenna provides advantageous gain in a relatively small physical package that is near optimum in terms of gain and size when compared to other known antennas. In one application, the antenna offers desired performance features in an earth-based communications handset for communicating with a satellite.

In one embodiment, a QHA of the present invention operates over a frequency band from 2630 to 2655 MHz (i.e., a bandwidth of approximately 1%). The radiation pattern favors right hand circular polarization (RHCP). Within a solid angle of about 45 degrees from the zenith the gain is about 2.5 dBrhcpi, that is, more than 2.5 decibels relative to a right hand circularly polarized isotropic antenna. The gain at the zenith approaches 4.0 dBrhcpi. The standing wave ratio (SWR) is about 1.5:1 over the frequency range of 2630 to 2655 MHz. The QHA of the present invention, or derivative embodiments thereof, may satisfy requirements for use with an earth-based communications device for sending and/or receiving signals from a satellite, such as a GPS satellite or satellite commercial radio systems operated by XM Radio and Sirius.

Figure 2:
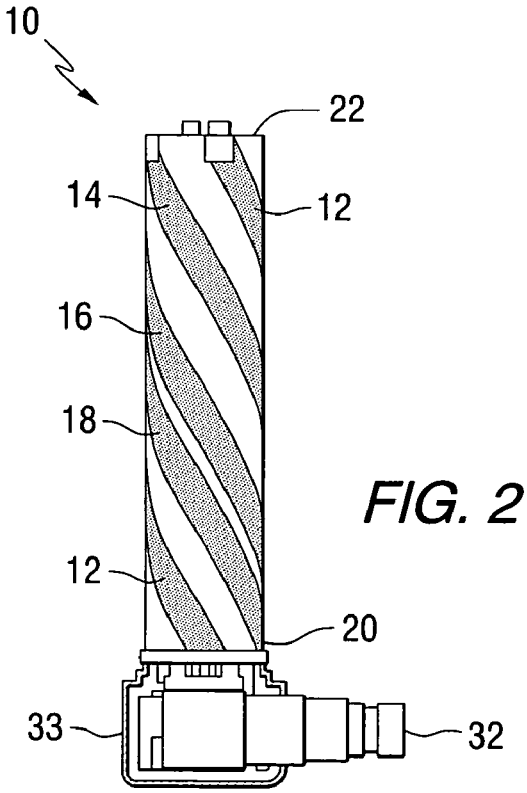

FIGS. 1 and 2 illustrate a QHA 10 according to the teachings of the present invention, comprising filar windings 12, 14, 16 and 18 extending from a bottom region 20 to a top region 22 of the QHA 10, which is generally in the shape of a cylinder. FIG. 1 illustrates a QHA wherein the oppositely disposed filars 12 and 16 are conductively connected by a conductive bridge 23, and the filars 14 and 18 are conductively connected by a conductive bridge 24. Signals propagating on the filars 12/16 are in phase quadrature with signals propagating on the filars 14/18, to produce the desired circular signal polarization. In a preferred embodiment, the filars 12, 14, 16 and 18 each comprises a conductive element, such as a wire having a circular or rectangular cross-section or a conductive line or trace on a dielectric substrate.

As is known in the art, conductive bridges are employed with QHA'S having a filar length equal to an even number of quarter wavelengths at the operating frequency, but are not typically used when the filar lengths comprise an odd number of quarter wavelengths. In one embodiment, each conductive bridge 23 and 24 (also referred to as a crossbar) comprises a conductive tape strip.

In the embodiment of FIGS. 1 and 2, the four filar conductors 12, 14, 16 and 18 extend in a substantially uniform helical pattern from the bottom region 20 to the top region 22 of an imaginary cylinder. In another embodiment, not illustrated, one or more of the filars is disposed about the cylinder in a zigzag or serpentine pattern from the bottom region 20 to the top region 22.

In embodiments implementing the structure of FIGS. 1 and 2, and for use in the band from 2630 to 2655 MHz, the cylinder diameter ranges from about 8 mm to about 10 mm. An antenna constructed according to the present invention provides a peak gain in excess of about 3.5 dBrhcpi. The maximum gain at the zenith occurs with a filar pitch angle of about 45 degrees. Increased gain within a 45 degrees solid angle from the zenith can be achieved by using a pitch angle of about 60 degrees. In another embodiment, the pitch angle is about 75 degrees, but it has been observed that the 60-degree pitch angle provides adequate gain within the 45 degrees solid angle for an intended application. Generally, lowing the pitch angle increases the gain at the zenith. An antenna constructed with a 60-degree pitch angle exhibits a shorter axial height than one with a pitch angle of 75 degrees, which may also be advantageous for some applications. Higher pitch angles tend to produce a beam peak at lower elevation angles while maintaining the peak for all azimuth angles. Also, use of a higher pitch angle tends to broaden the bandwidth and lower the SWR. An antenna constructed with a pitch angle of about 45 degrees has a narrower bandwidth and a higher SWR than a QHA with a 60 degrees pitch angle. The balanced and essentially resonant conditions to achieve satisfactory circular polarization generally suggest narrow band antennas.

A nominal length of each filar 12, 14, 16 and 18 is about 25 mm for an approximately quarter-wavelength antenna structure operative at about 2642.5 MHz. The nominal filar length is about 46 mm for a half-wavelength QHA. Based on these filar lengths and a pitch angle of about 60 degrees, the antenna axial height is about 18 mm for the quarter-wavelength QHA and about 39 mm for the half-wavelength QHA. In one embodiment of the quarter-wavelength QHA, the antenna comprises a diameter of about 16 mm. In a one half-wavelength embodiment, the filar structure diameter is about 8.5 mm. When completely assembled with a radio frequency connector, radome housing and a short cable disposed between the antenna and the connector, the overall dimensions are 68 mm in height and 12 mm diameter.

The half-wavelength QHA radiation pattern exhibits better forward gain and a smaller back lobe in the radiation pattern than the quarter-wavelength QHA. In other embodiments, three-quarter, five-quarter, etc. wavelength QHA'S can be utilized according to the teachings of the present invention. It is known that the higher fractional quarter wavelength embodiments provide a higher gain at the peak of the beam, i.e., a narrower radiation pattern, expanded bandwidth and a higher front hemisphere-to-back hemisphere ratio.

In a preferred embodiment of the present invention, lengths of the QHA filars are modified from the nominal length. That is, the filars 12, 14, 16 and 18 comprise a first pair or loop of long filars (e.g., filars 12 and 16) and a second pair or loop of short filars (e.g., 14 and 18), where long and short are measured with respect to the nominal length related to the antenna's resonant frequency, i.e., a nominal length of about 25 mm for a quarter-wavelength antenna operating at about 2642.5 MHz, including the length of the conductive bridge 23/24 and a segment of the feed structure for matching the antenna impedance to the feed structure impedance, which is described below, such that the total length circumscribes a conductive loop. The length differential between the two filar pairs maintains the phase quadrature relationship for the signals propagating on the four filars.

In a half-wavelength embodiment, the long filars each have a length of about 46 mm and the short filars each have a length of about 44.5 mm, where both lengths include the length of the conductive bridge of each filar pair and a conductive segment of the feed structure (for matching the antenna impedance to the feed structure impedance), which is described below, such that the total length circumscribes a conductive loop.

As can be seen in FIG. 1, each of the conductive bridges 23 and 24 connects oppositely disposed filars, with an air gap 28 therebetween due to the length differential of the filars. The air gap distance thus in one embodiment controls the filar length differential. In another embodiment, the length differential is created by forming filars of unequal lengths, such as by employing different pitch angles, for the two filar pairs. Other embodiments comprising the use of other conductive structures for connecting the filar pairs are described below.

In the quarter-wavelength embodiment of the present invention for operation at about 2642.5 MHz, the long and the short filar lengths are about 23.325 mm and about 21.075 mm, respectively.

Consumer marketing considerations for emerging applications for antennas of this type, such as consumer electronic devices such as a handset as described below, tend to impose the smallest possible size on the antenna developer. The dimensions of certain of the QHA embodiments of the present invention were driven by customer requirements, and it is suggested that these dimensions are very close to the minimum size capable of providing the desired radiation pattern and bandwidth performance. It has been observed that at smaller dimensions the antenna elements tend to self absorb the radiation.

A communications handset is one application for the QHA 10. With reference to FIGS. 1 and 2, a radio frequency connector 32 provides an electrical connection to receiving and/or transmitting elements of the handset. In a transmit mode, a radio frequency signal is supplied to the QHA 10 from transmitting elements within the handset via the connector 32. In a receiving mode, the radio frequency signal received by the QHA 10 is supplied to handset receiving elements via the connector 32. As further described and illustrated below, the QHA 10 further comprises a radome, including a radome base 33 illustrated in FIGS. 1 and 2.

An antenna of the present invention can be configured with an antenna signal feed (such as the signal feed described below) disposed at the top region 22 or the bottom region 20. The QHA 10 exhibits different operating characteristics (including the radiation pattern) depending on whether the antenna is top fed or bottom fed. But in either case, a majority of the energy is radiated in a direction of the zenith.

If the antenna signal feed is disposed in the bottom region 20, the QHA is operative in a forward fire axial mode with the signal feed connected directly to a signal conductor, such as a 50 ohm coaxial cable.

If the antenna signal feed is disposed proximate the top region 22, the QHA operates in a backward fire axial mode. In one embodiment of a backward fire axial mode QHA, a transmission line is connected to a signal feed structure within the top region 22 and extends to the bottom region 20 (and in one embodiment extends below the bottom region 20) where the transmission line is connected to a 50 ohm coaxial cable. The transmission line can operate as a quarter wavelength transmission line transformer to match the antenna impedance presented at the signal feed (also referred to as the driving point impedance) to the 50 ohm characteristic impedance of the coaxial cable. In certain applications the bottom feed structure is preferred as it eliminates the need for the transmission line (or transmission line transformer) extending between the top region 22 and the bottom region 20.

The QHA of the present invention, like all antennas, presents a driving point impedance (at its signal feed terminal) to a transmission line feeding the antenna. For optimum power transfer, it is desired to match the antenna driving point impedance to a characteristic impedance of the transmission line, also referred to as a source or load impedance. An impedance match occurs when the resistive or real component of the antenna and the source impedance are equal, and the reactive or imaginary components are equal in magnitude and opposite in sign. Since a commonly used transmission line has an impedance of 50 ohms, it is desired to construct the QHA of the present invention with a 50 ohm impedance or an impedance that can be conveniently transformed to 50 ohms, for connection to the 50 ohm transmission line.

As described above, use of the QHA for a specific application drives the antenna's operating and physical characteristics. To achieve these characteristics, the QHA presents a relatively narrow diameter cylinder, and the relatively narrow diameter cylinder produces a driving point impedance below 50 ohms, including an inductive component. It has been found that for certain embodiments, the impedance is in a range of about 3 to 15 ohms. Similar inductance values are presented for all quarter-wavelength multiples, e.g., ¼, ½, ¾, 5/4, 7/4, etc. To achieve a 50 ohm antenna driving point impedance requires a cylinder diameter greater than is generally considered acceptable for use with the communications handset.

An impedance matching element 48 (see FIG. 3) matches the antenna driving point impedance to the source impedance, according to the teachings of the present invention. The matching element 48 comprises an "H-shaped" conductive element 50 disposed on a dielectric substrate 52, e.g., the conductive element 50 and the dielectric substrate 52 comprise a printed circuit board having a conductive pattern thereon. The impedance matching element 48 further comprises a signal feed terminal 54 (proximate a center of the substrate 52 orienting the various elements of the QHA symmetrically with respect to the substrate center). The center-fed impedance matching element 48 overcomes the disadvantages of the prior art baluns, providing a matching structure that can be physically integrated with the antenna radiating elements to present an integrated radiating and impedance matching structure for incorporation into a communications device, such as a handset.

In the illustrated embodiment, the QHA 10 is fed from a coaxial cable 55 comprising a center conductor 56 connected to a terminal 57A of a capacitor 57, and further comprising a shield 58. An inductor 59 is connected between the center conductor 56 and the shield 58. In a preferred embodiment, the capacitor 57 has a value of about 1.8 pF and the inductor 59 has a value of about 2.2 nH. The capacitor and inductor value are selected to provide the desired impedance match, when operating in conjunction with the structural features of the feed and the antenna elements that also affect the impedance match. The capacitor 57 and the inductor 59, disposed as shown, form a two-element impedance match between the source impedance (of the coaxial cable 55) and the QHA 10. Thus, the antenna's natural driving point impedance is transformed by the capacitor and the inductor to approximately 50 ohms.

A length of the center conductor 56 should be kept short as in known by those skilled in the art. It is also known in the art that a balun can be connected proximate the signal feed terminal 54 to prevent stray radio frequency fields from generating a current in the shield 58.

A terminal 57B of the capacitor 57 is connected to a conductive element 60 of the impedance matching element 48 via a conductor 70. The conductive element 60 is conductively continuous with conductive pads 61 and 62. The shield 58 of the coaxial cable 55 is connected to conductive pads 72 and 74 via a conductive element 78. In one embodiment, a solder filet conductively connects the shield 58 to the conductive element 78. The filars 12 (long), 14 (short), 16 (long) and 18 (short) are disposed within openings 72A, 74A, 60A and 62A, respectively, as defined in the respective conductive pad and extend vertically from a plane of the impedance matching element 48. A solder filet (see FIG. 11) bridging the conductive pad and its respective filar forms the conductive connection therebetween.

To form the impedance matching element 48, in one embodiment a conductive layer is disposed on the dielectric substrate 52, and the conductive pads 61, 62, 72 and 74 and the conductive element 78 are formed by selective subtractive etching of the conductive layer.

It is noted that the filars 12 and 16 (both long) are oppositely disposed on the helix relative to a center of the substrate 52. Similarly, the filars 14 and 18 (both short) are oppositely disposed relative to the substrate center. Thus the conductive element 60 of the impedance matching structure 48 connects the long filar 18 and the short filar 16. Similarly, the conductive element 78 connects the long filar 12 and the short filar 14. The conductive bridges 23 and 24 connect the filars at their upper end as described above.

The impedance matching element 48 may be disposed at the proximal end, as described, or a distal end of the QHA 10. The physical features of the matching element 48 (including the value of the capacitor and the inductor) may change from those described above when placed at the distal end.

Exemplary current flow in the impedance matching element 48 is indicated by an arrowhead 100 from the shield 58 through the conductive element 78 to the conductive pad 72. Current flow continues through the long filar 12, the conductive bridge 23, and the long filar 16 (see FIG. 1) to the conductive pad 61. An arrowhead 102 depicts current flow from the conductive pad 61 through the conductive element 60 and the capacitor 57 to the center conductor 56.

Similarly, current flow is indicated by an arrowhead 104 from the shield 58, through the conductive element 78 to the conductive pad 74. Current flow continues through the short filar 14, the conductive bridge 24, and the short filar 18 (see FIG. 1) to the conductive pad 62. An arrowhead 106 depicts current flow from the conductive pad 62 to the center conductor 56 via the conductive element 60 and the capacitor 57.

Figure 3:
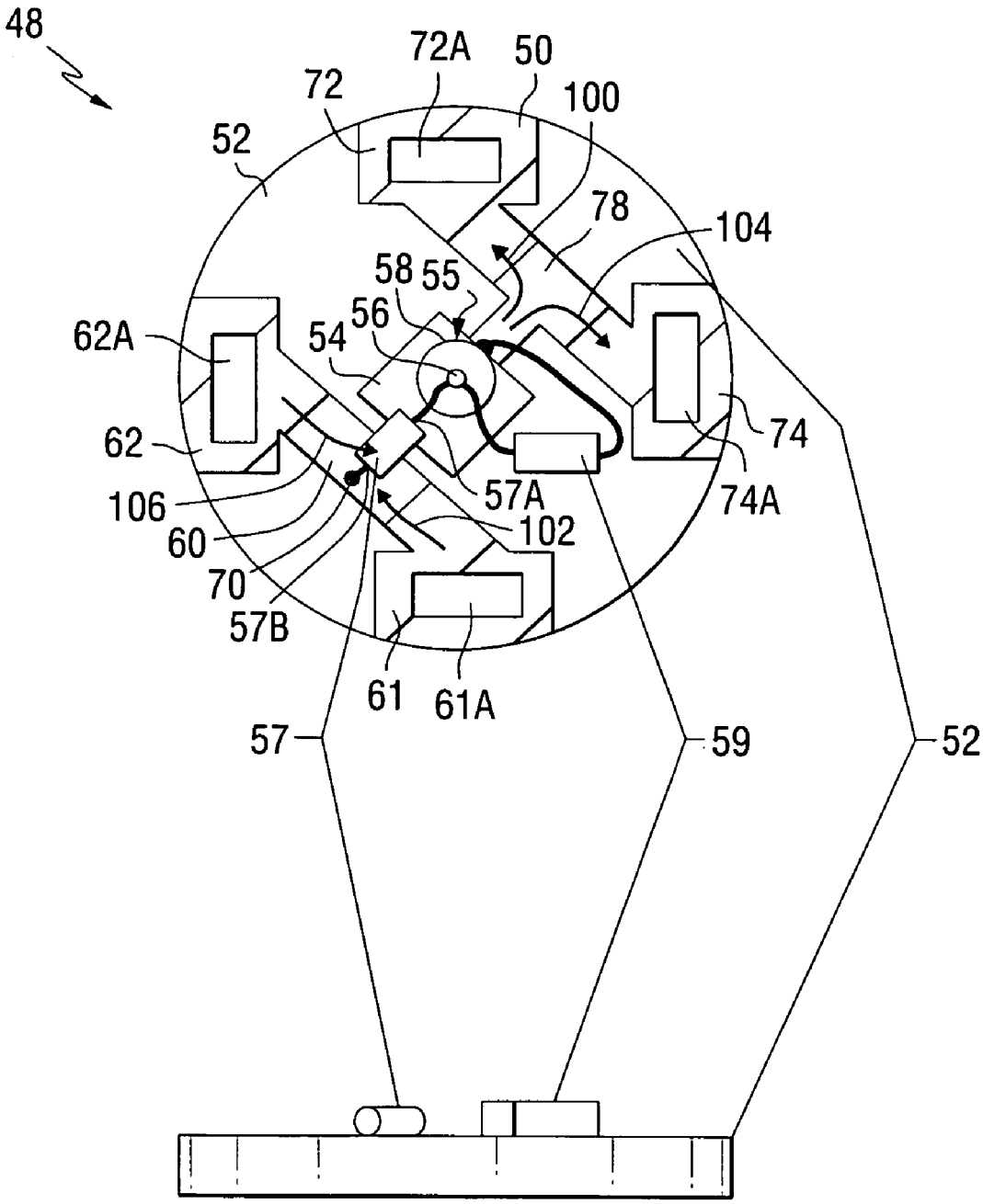
FIG. 3 illustrates an impedance matching element, according to the teachings of the present invention, for use with the QHA of FIGS. 1 and 2.
Figure 5:
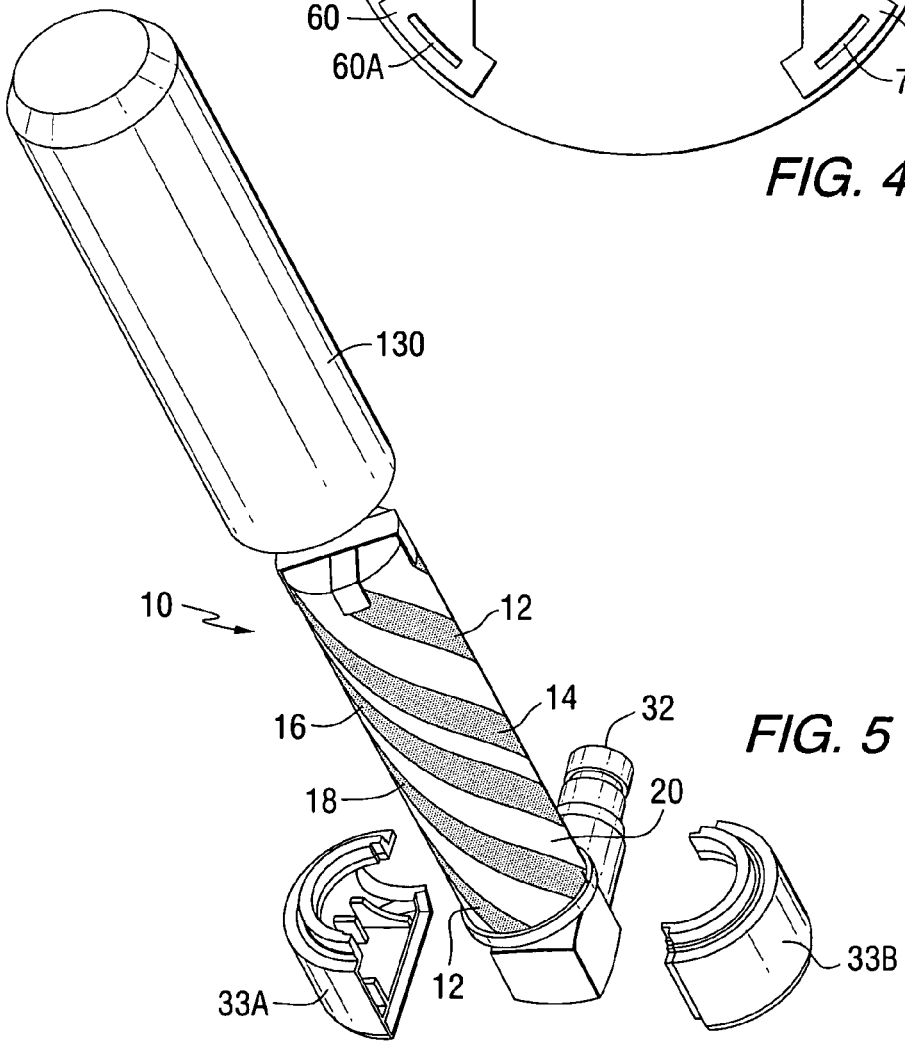
FIG. 5 illustrates a QHA according to the present invention including a radome.

It is known by those skilled in the art that various radio frequency connectors can be used in lieu of the coaxial cable 55 of FIG. 3. For example, as illustrated in the embodiments of FIGS. 1, 2 and 5, the connector 32 is connected to the antenna feed terminal. Terminals of the connector 32 mate with a signal cable, not shown in FIG. 3, that comprises a signal conductor and a ground conductor. The signal conductor is operative in lieu of the center conductor 56 of the coaxial cable 55, and the ground conductor replaces the shield 58. Both are connected to the impedance matching element 48 in a manner similar to connection of the coaxial cable 55 as described above.

For an exemplary QHA structure having a diameter of about 8.5 mm and a pitch angle of about 60 degrees, the net reactance is about 1.6 nH (j26) at 2642.5 MHz; the resistance is about 12 ohms, for a impedance (Zdp) of about 12+j26 ohms. Note that the reactive component is about twice the series equivalent resistance. Although the actual driving point impedance depends on the antenna diameter and filar pitch angle, this tendency toward an inductive impedance of about twice the value of the resistive component may provide adequate antenna gain and SWR, while providing an acceptable solution for the quadrature relationship between the filars such that a circularly polarized signal is radiated.

It has also been found that the peak QHA gain tends to occur at a frequency slightly below a frequency where the lowest SWR is observed. Thus according to one embodiment, the QHA sacrifices some gain while achieving a satisfactory SWR. However, computer-based design iterations can be performed to adjust the filar dimensions, such as filar length (both or either of the short filar and the long filar), the filar cross-section, the cylinder radius, the filar pitch angle and the matching component values (i.e., the capacitor 57 and the inductor 59) to achieve a greater peak gain but with a higher SWR. Once these filar dimensions and match component values are determined, an antenna constructed based thereon presents reasonable process tolerances to achieve the desired performance.

Design of a QHA according to the present invention considers the relationship between the various antenna physical parameters and the desired operating characteristics. According to one embodiment as described above, the antenna physical parameters are optimized to present an antenna driving point impedance (i.e., a series equivalent impedance) having a real part less than 50 ohms and a positive reactive part. In various embodiments of the invention the remaining reactive component due to the inductance of the conductive structures in the impedance matching element 48 is proportional to the length of those structures. Generally, the reactive component is about twice the resistive component or is in the range of 20 to 40 ohms reactive. According to investigations performed by the inventors, it appears that the QHA exhibits desired, gain, bandwidth, etc. parameters when this relationship between the real and reactive impedance components is presented.

According to one application, it is desired for the QHA to have a relatively small cylindrical diameter for use with the handset communications device. The antenna characteristic impedance is directly related to the antenna diameter, i.e., a smaller diameter lowers the characteristic impedance. Reducing the diameter also lowers the resonant frequency and reduces the bandwidth. A small diameter QHA with equal length first and second filar pairs tends to present a somewhat wider bandwidth and a somewhat higher peak gain, when compared to an embodiment with unequal length filar pairs. However, an elaborate quadrature feed network, such as the branch line hybrid couple described above in the Background section, is required to drive a QHA with equal length filars. By contrast, according to the present invention adequate bandwidth and gain can be achieved by utilizing different length filar pairs operating with a quadrature feed network for impedance matching, such as the impedance matching elements 48 (described above in conjunction with FIG. 3) and 110 (described below in conjunction with FIG. 4).

The capacitor 57 and the inductor 59 of the impedance matching structure 48 of FIG. 3 are selected to provide an impedance match between the driving point impedance of the QHA and the 50 ohm characteristic impedance of the coaxial cable 55 connected to the antenna signal feed terminal 54. As is known in the art, in another embodiment the lumped inductor and capacitor can be replaced by distributed components for performing the impedance matching function, such as a capacitor formed by interdigital conductive traces on the substrate 52 and an inductor formed by a conductive trace in the form of one or more conductive loops or a linear conductive segment. In a further embodiment, the source characteristic impedance is other than 50 ohms, and thus the capacitor and inductor are selected to match to this impedance.

According to another embodiment, a balanced transmission line, selected from one of the various types known in the art, is used instead of the coaxial cable 55. Each conductor of the balanced transmission line is attached to a conductive pad, with the conductive pads disposed on opposing surfaces of a printed circuit board, such as the substrate 52 of FIG. 3. Each pad is further connected to the signal feed terminal 54 of FIG. 3 using conventional connection techniques.

As is recognized by those skilled in the art, different dimensions for the components of the QHA 10 (e.g., a different diameter, different filar lengths or a different filar pitch angle) can be used in another embodiment. These parameters may change the differential length between the first and the second filar pairs and/or the antenna load impedance, which in turn changes the value of the inductor and/or the capacitor for matching the antenna impedance to the source impedance. In one embodiment, the impedance match may require only a single component (either an inductor or a capacitor). However, as discussed above, to optimize the antenna operating characteristics, it may be preferable for the driving point impedance to include a reactive component.

To achieve optimum bandwidth, gain and quadrature signal distribution (which is required for a circularly polarized signal) it is desired that the long and the short filar pairs have an approximately equivalent diameter (or an equivalent cross-section for filars having a quadrilateral cross-section (i.e., length and width) such as filars comprising a conductive trace on a dielectric substrate). It may be possible, however, to accommodate slightly divergent diameters without dramatically affecting antenna performance. Use of same diameter conductors also simplifies the physical filar structure and maintains antenna symmetry.

In one embodiment, the QHA diameter is about 8.5 mm, and thus the antenna circumference is about 25 mm. It is desired to use as wide a conductor as practical to lower the conductor resistance (i.e., reduce ohmic losses), which correspondingly tends (to a point) to broaden the antenna bandwidth. It is also recognized that the filars must be separated by a sufficient distance to reduce filar-to-filar coupling and dielectric loading. In one embodiment, the filar diameter is determined by dividing the antenna circumference by eight and rounding to a convenient integer value. Thus, a 25 mm circumference yields a filar diameter of about 3 mm. According to an embodiment wherein a filar comprises a flat conductor, a half conductor, half dielectric relationship is used to establish a conductor width. Several embodiments of the antenna according to the present invention have favored the above conductor-to-insulator ratio, although it is recognized that other embodiments may favor other ratios. As is known by those skilled in the art, in performing analyses of such QHA'S, a flat conductor can be represented by a round conductor where a diameter of the round conductor is one-half the flat conductor width.

In one embodiment presented above, the driving point impedance of 15+30j is transformed by the impedance matching element 48 (specifically the capacitor 57 and the inductor 59) to 50 ohms for matching the characteristic impedance of the coaxial cable 55. According to another embodiment, such as a quarter wave version of a QHA described below according to the teachings of the present invention, a capacitor and/or an inductor transform the driving point impedance of 3+6j to about 12.5 ohms, and a quarter wavelength transformer transforms the 12.5 ohm impedance to 50 ohms. A quarter wavelength transmission line having a 25 ohm characteristic impedance ($Z_0$) transforms the 12.5 ohms impedance to 50 ohms according to the equation, $Z_0$=sqrt [(driving point impedance)*(source impedance)].

Figure 4:
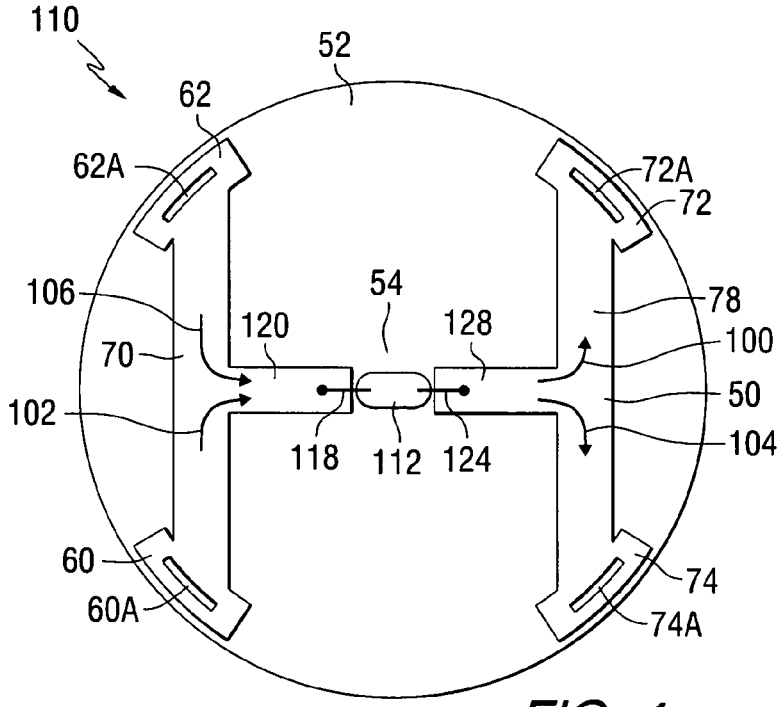
FIG. 4 illustrates another embodiment of an impedance matching element according to the teachings of the present invention.

FIG. 4 illustrates an embodiment of an impedance matching element 110 including a quarter wavelength transmission line transformer 112 connected at the signal feed terminal 54 to match a 12.5 ohms impedance to 50 ohms. The transmission line transformer 112 comprises a conductor 118 connected to an arm 120 of the conductive element 50, and a conductor 124 connected to an arm 128.

As can be appreciated by those skilled in the art, in an embodiment where the antenna's physical parameters create a purely resistive driving point impedance of about 12.5 ohms, the impedance matching element 110 is sufficient to transform the driving point impedance to 50 ohms. The impedance matching element 48 is not required.

A radome is advantageous to avoid antenna damage during user handling of the communications device to which the antenna is connected. Radome material, thickness and shape is chosen to minimize effect on the antenna's receiving and transmitting properties, i.e., to present relatively low loss over the antenna's operating frequency range. The dielectric loading effect of the radome can be considered in designing the QHA to achieve operation at the desired resonant frequency and desired bandwidth. A suitable radome 130 for the QHA 10 is illustrated in FIG. 5. As can be seen, the radome 130 mates with the radome base components 33A and 33B that enclose the lower region 20 of the QHA 10.

Figure 6:
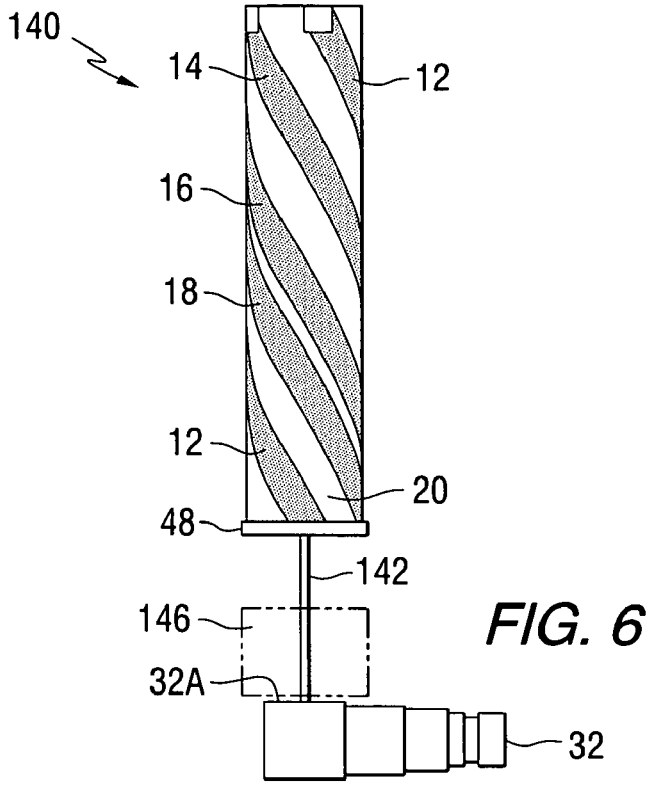
FIGS. 6–8 illustrate other embodiments of a QHA according to the present invention.

Another embodiment according to the teachings of the present invention is represented by a QHA 140 illustrated in FIG. 6, comprising a conductor 142, preferably a coaxial cable comprising an inner conductor and an outer shield, extending between the connector 32 and the impedance matching element 48 within the bottom region 20 of the QHA 140. Typically, due to a length of the conductor 142, the impedance matching element sees a different impedance with the conductor 142 in place than when the QHA 140 is connected directly to the connector 32, such as shown in FIG. 5. Thus the impedance matching components of the impedance matching element 48 must be modified to provide an appropriate impedance match for the QHA 140. In a preferred embodiment the conductor 142 comprises a flexible conductive material that can absorb mechanical shock and vibrations caused by dropping or striking the QHA 140 against a rigid object, reducing the likelihood of damage to the QHA 140. The length of the conductor 142 provides a physical separation between the connector 32 and the QHA 140 in a handset mounting application where such a separation is advantageous.

Figure 7:
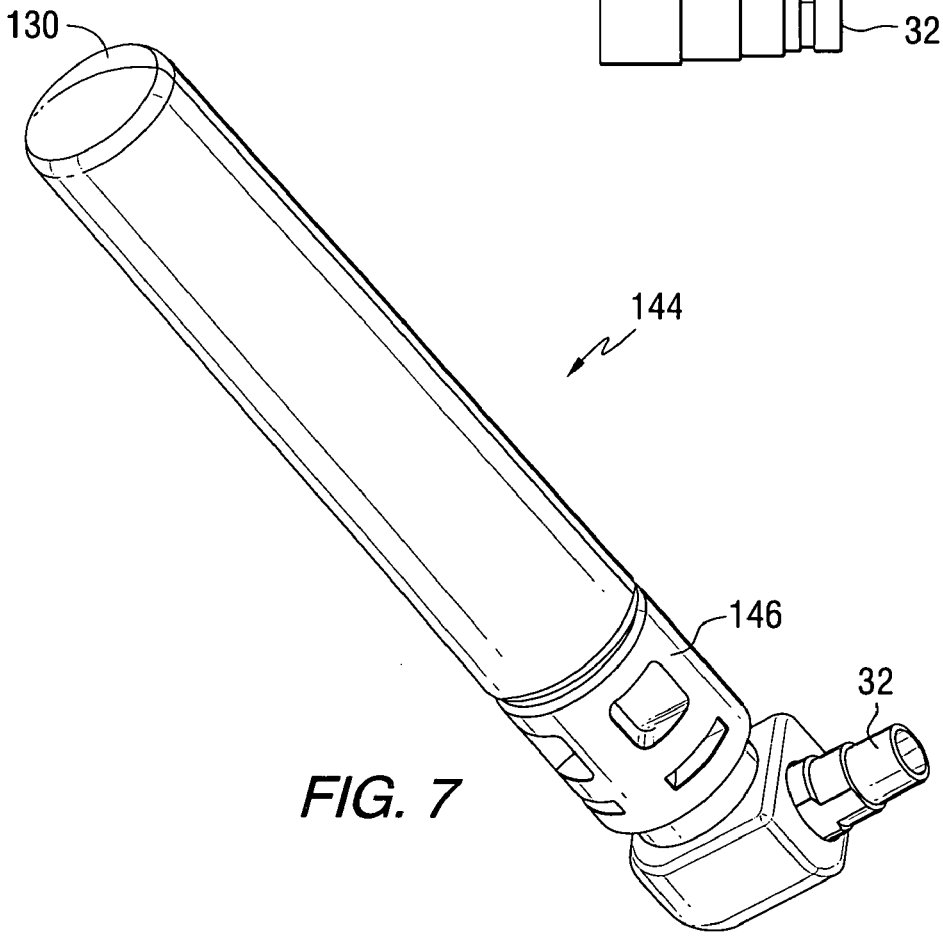

In an embodiment of FIG. 7, a QHA 144 further comprises an over-molded deformable (e.g., semi-plastic) member 146 enclosing the conductor 142 and in one embodiment affixed to the impedance matching element 48 and to a surface 32A (see FIG. 6) of the connector 32. The member 146 provides shock absorbing capability when the antenna is dropped. The QHA 144 further comprises the radome or cover 130. The over-molded member 146 can also be used in conjunction with the embodiment of FIG. 6, wherein a portion of the conductor 142 is enclosed by the over-molded member 146.

Figure 8:
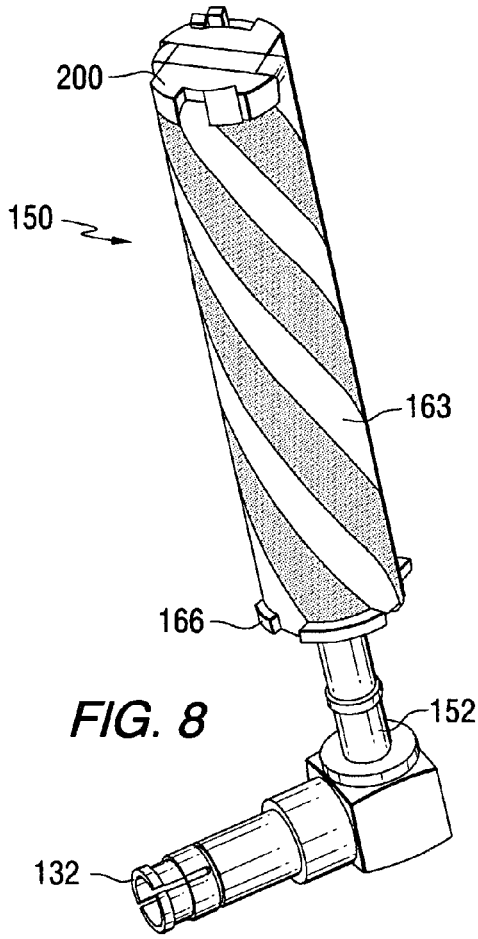

FIG. 8 illustrates yet another embodiment of a QHA 150 comprising a conductor extending between the connector 32 and the impedance matching element 48 enclosed within a sleeve 152.

Figure 9:
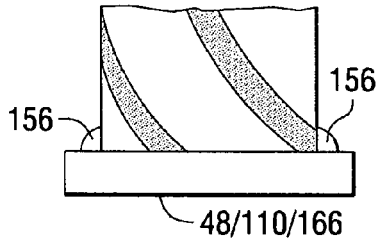
FIG. 9 illustrates solder filets for connecting the impedance matching element and the QHA.

To ensure desired performance parameters for the QHA it is preferable to maintain the antenna dimensions and limit flexing of the filars 12, 14, 16 and 18 during operation. To provide consistent antenna performance, it is also desired to control a shape and a mass of solder filets 156 (see FIG. 9) that conductively connect each filar to its respective mounting pad 72, 74, 60 and 62 of the impedance matching element 48 (see FIG. 3). It is known that varying a shape, mass and/or size of one or more of the solder filets 156 can change the current path length of the QHA filars, and thus can alter various performance parameters, including the antenna's resonant frequency. In certain manufacturing process for producing the QHA 10, the solder filets 156 are formed by a hand soldering operation leading to potential performance variability.

To overcome the filar flexing, in one assembly process the substrate 160 (see FIG. 10) comprising filars 162, is wound about a tubular mandrel 163 (see FIG. 11) and retained in the cylindrical shape by the mandrel 163, i.e., the mandrel remains in place after fabrication of the QHA 10. Various known adhesives are suitable for attaching the substrate 160 to the mandrel 163. A material of the mandrel 163 is chosen to exhibit low loss at the antenna's operational frequencies, while providing mounting integrity and stability for the substrate 160.

The mandrel 163 dielectrically loads the QHA 10, which tends to lower the antenna resonant frequency. Thus the dielectric loading imposed by the mandrel 163 should be considered when determining the antenna dimensions to overcome the loading effects. Other antenna embodiments in which the dielectric loading effect is reduced are described below.

Figure 10:
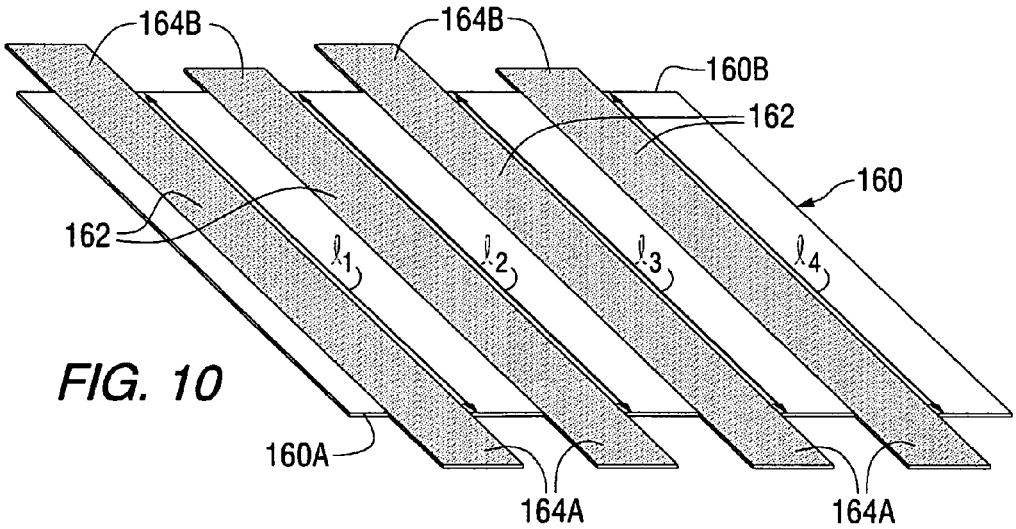
FIG. 10 illustrates a substrate for use in fabricating a QHA according to the present invention.
Figure 11:
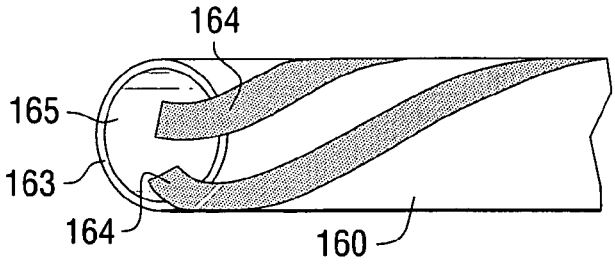
FIG. 11 illustrates another embodiment of a QHA of the present invention including a mandrel.

Each filar 162 further comprises a finger segment 164A extending beyond a bottom edge 160A of the substrate 160 and a finger segment 164B extending beyond a top edge 160B of the substrate 160 (see FIGS. 10 and 11). The finger segments 164B are illustrated as having unequal lengths to form the unequal length filars of the QHA as described above. In another embodiment not illustrated, the finger segments 164B are of substantially equal length and the unequal total filar conductive length is a result of the differential electrical path length of the conductive bridges 23 and 24 or other conductive bridge or crossbar embodiments described below.

Figure 12:
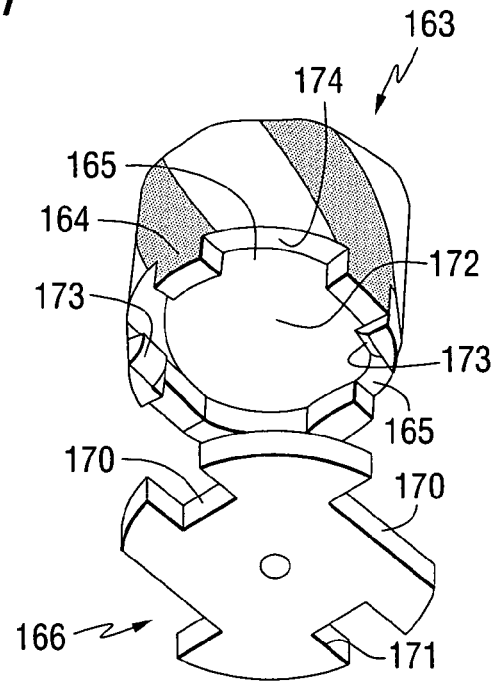

As can be seen in FIG. 12, each finger segment 164A wraps about a tab 165 in the mandrel 163 when the substrate 160 is disposed about the mandrel 163. According to this embodiment, an impedance matching element 166, similar in functionality to the impedance matching element 48, comprises a disk-like structure with the impedance matching components (as further described in conjunction with FIG. 3) mounted on an upper surface that is hidden from view in FIG. 12, and conductive regions 170, each in conductive communication with the conductive elements on the upper surface, wherein these conductive elements provide the functionality of the conductive pads 61, 62, 72 and 74 and the conductive elements 60 and 78 of the impedance matching element 48 of FIG. 3. Preferably, the conductive regions 170 are formed co-extensive with the conductive pads and elements according to known printed circuit board subtractive conductor etching techniques. The impedance matching element 166 further comprises a feed terminal 171 for connection to the conductor 142 of FIG. 6, for example.

The impedance matching element 166 is captured within an opening 172 at a lower end of the mandrel 163. Each finger segment 164A (and corresponding tab 165) is thereby urged into conductive communication with one of the conductive regions 170 to electrically connect the filars 162 to the impedance matching components mounted on the upper surface of the impedance matching element 166.

Figure 13:
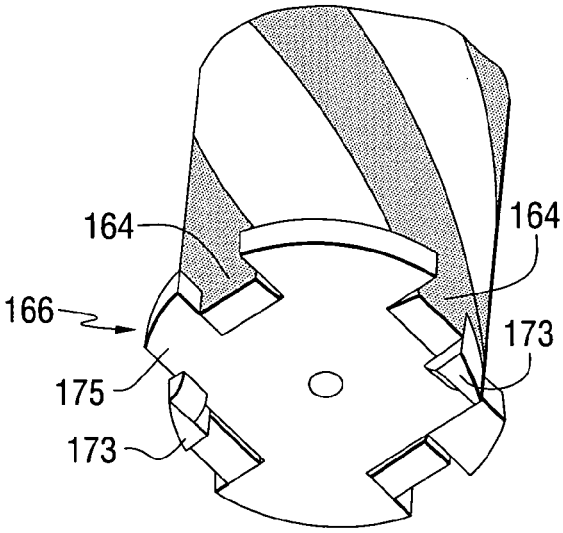
FIGS. 12–14 illustrate an embodiment of an impedance matching element for use with the QHA.
Figure 14:
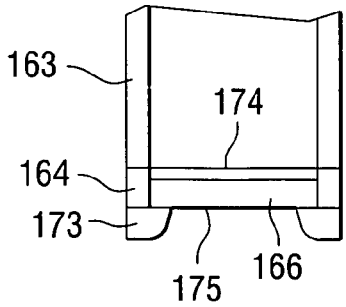

Oppositely-disposed capture tabs 173 (a single capture tab 173 may suffice in one embodiment) extending from a bottom edge 174 of the mandrel 163, capture and apply an upwardly directed force to a lower surface 175 of the impedance matching element 166, urging the element 166 against the bottom edge 174, thereby retaining the element 166 within the opening 172 of the mandrel 163. See also FIGS. 13 and 14. To install the impedance matching element 166, the cylindrical shape of the mandrel 163 is slightly distorted by the application of suitably directed forces so as to permit insertion of the element 166 against the bottom edge 174. Upon removal of the distorting forces, the mandrel 163 returns to its normal shape and the impedance matching element is captured as described. Although the impedance matching element 163 is illustrated in the Figures. as having a particular shape including a plurality of notches formed therein, those skilled in the art recognize that other shapes non-illustrated may be suitable.

In another embodiment, the flexible film is replaced by a rigid cylindrical structure on which conductive strips forming the helical traces are disposed, for example, by printing conductive material on outer surface of the cylindrical piece or by employing a subtractive etching process to remove certain regions from a conductive sheet formed on the outer surface, such that the remaining conductive regions form the helical traces.

Figure 15:
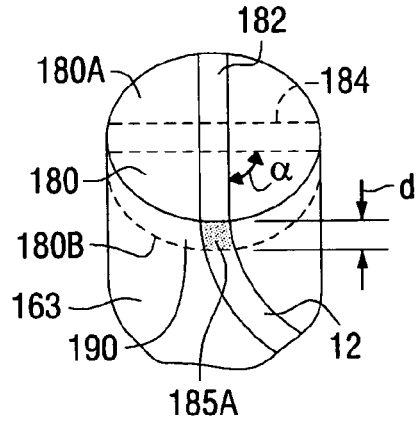
FIG. 15–17 illustrate various embodiments of conductive bridges for use with the QHA of the present invention.

In yet another embodiment, the conductive bridges or crossbars 23 and 24 are replaced with a generally circular substrate (or printed circuit board) 180, having a thickness d (see FIG. 15) with conductive crossbar strips 182 and 184 disposed on opposing surfaces 180A and 180B thereof In one embodiment, the distance d is about 1 mm. Each of the filars 12, 14, 16 and 18 comprises the finger segment 164B (see FIG. 10) at the crossbar end thereof. Each finger segment 164B extends into an upper opening 190 of the mandrel 163. The crossbars 182 and 184 are electrically connected to one of the filars 12, 14, 16 and 18 via conductive regions 185A–185D (only one of which is illustrated in FIG. 15) spaced about a circumferential edge of the substrate 180, such that when the substrate 180 is frictionally engaged within the upper opening 190, the conductive regions 185A–185D electrically connect and physically mate with the filar finger segments 164B. In one embodiment the conductive regions 185A–185D comprises gold-plated conductive material to reduce oxidation at the surface thereof Use of the substrate 180 provides additional dimensional stability to the QHA 10 by controlling the distance between the filars at the upper end of the antenna, according to the dimensions of the substrate 180. Dimensional changes at the upper end of the antenna can lead to frequency detuning and/or gain reduction. As discussed above, the distance d is related to the length differential between the long and the short filars.

Figure 16:
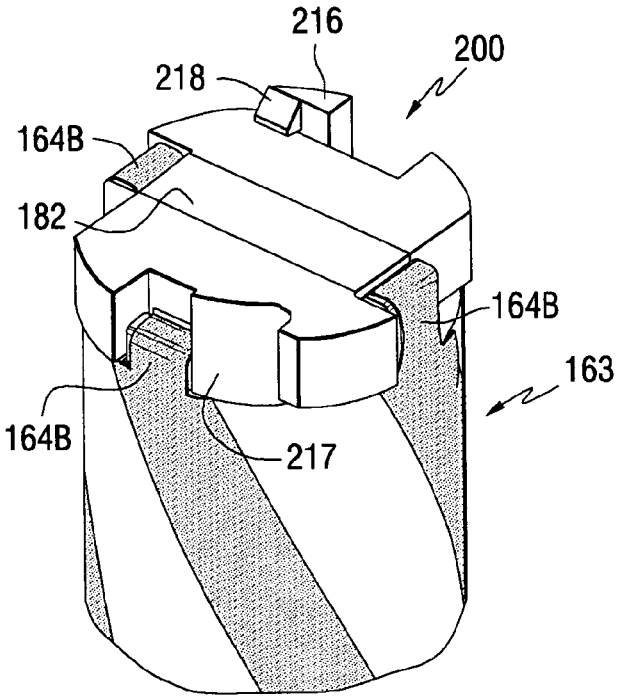
Figure 17:
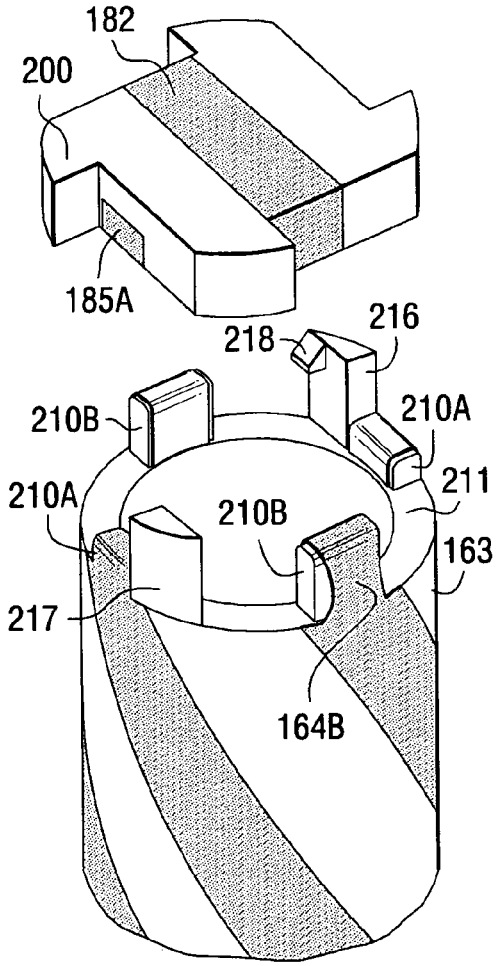

FIGS. 16 and 17 illustrate another embodiment of a circular substrate 200 supporting the conductive crossbars 182 (on an upper surface of the substrate 200) and 184 (not visible in FIGS. 16 and 17). The filar finger segments 164B are wrapped vertically about tabs 210A and tabs 210B, the tabs 210B extending farther from an upper edge 211 of the mandrel 163 than the tabs 210A. A terminal end of each finger segment 164B is disposed over an interior-facing surface of each tab 210A and 210B.

Capture tabs 216 and 217 extend from the upper edge 211, wherein the capture tab 216 further comprises a projection 218 extending inwardly from an interior-facing surface of the tab 216. The capture tabs 216 and 218 and the projection 218 cooperate to retain the substrate 200 against the upper edge 211 and properly aligned with the outer surface of the mandrel 163. In another embodiment, the capture tab 217 also comprises a projection 218.

The QHA embodiments of the present invention can be tuned by using electrically differentiated embodiments of the substrate 180 and/or of the impedance matching element 166. For example, due to coupling between the crossbars 182 and 184, the QHA can be tuned by varying the height d of the substrate 180, which modifies the parasitic capacitance and changes the resonant frequency of the QHA. The QHA can also be tuned by changing the dielectric constant of the substrate 180 or the impedance matching element 166, i.e., substituting a material having a different dielectric constant.

To expedite the antenna manufacturing process, a number of substrates 182 of varying height are manufactured. As each antenna is tested following manufacture, a substrate of the appropriate height is selected to tune the antenna to the desired resonant frequency.

In another embodiment, the relative orientation of the crossbars 182 and 184 is altered to tune the antenna. In FIG. 15 the crossbars 182 and 184 are separated by an angle $\alpha$ of about 70–80 degrees. Changing this orientation such that the angle $\alpha$ is less than 70–80 degrees modifies coupling between the crossbars 182 and 184 to effect antenna tuning.

Figure 19:
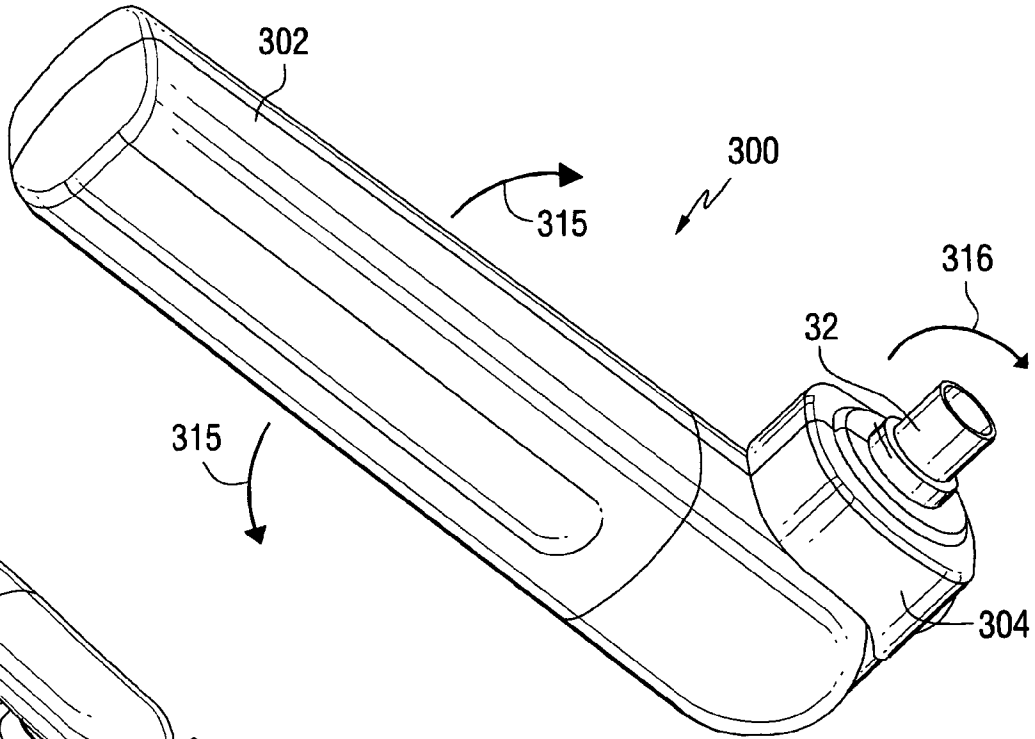
FIG. 18 and 19 illustrate another embodiment of a QHA of the present invention having a pivot or hinge member.
Figure 18:
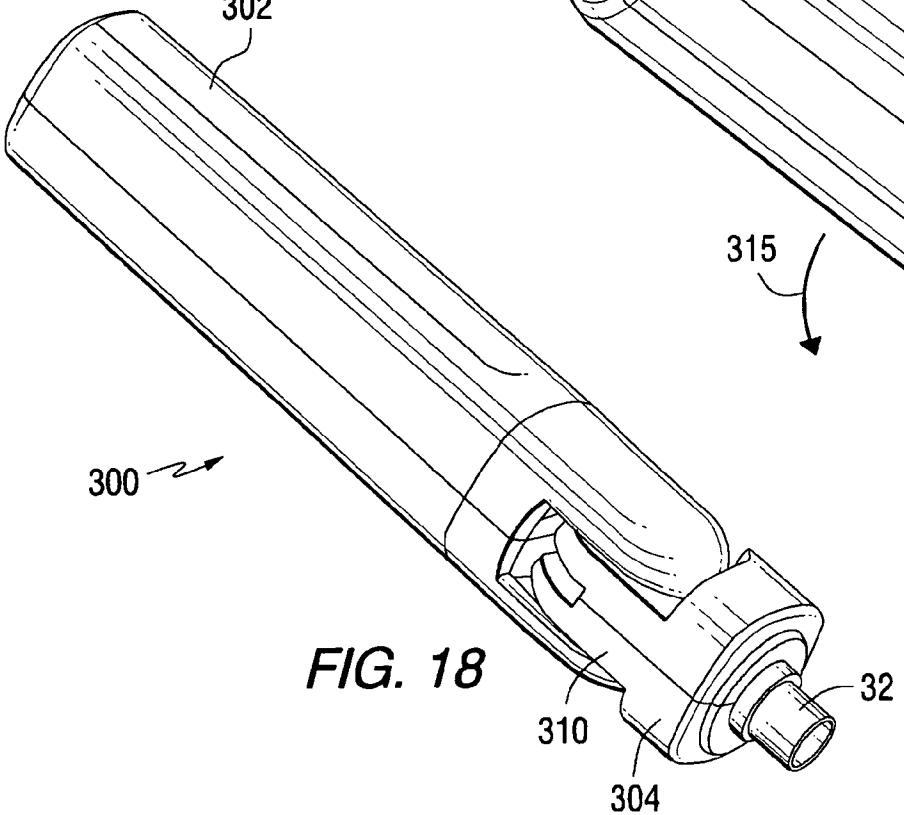

In another embodiment illustrated in FIGS. 18 and 19, an antenna assembly 300 comprises a generally cylindrical enclosing member 302 enclosing a QHA of the present invention. An enclosing member 304 encloses the impedance matching element and certain components associated with the connector. The enclosing members 302 and 304 are pivotably joined by a hinge structure 310 as illustrated.

In FIG. 18 the enclosing members 302 and 304 are substantially linearly oriented.

As illustrated in FIG. 19, the hinge structure 310 permits pivoting of the antenna 314 into a perpendicular orientation with respect to the connector 32. Depending on the characteristics of the hinge structure 310, an orientation greater than 90 degrees may also be permitted. Arrowheads 315 in FIG. 19 indicate a range of permitted angular orientations between the connector 32 and the antenna 314 as permitted by the hinge structure 310. An arrowhead 316 in FIG. 19 indicates that the connector 32, and thus the antenna assembly 300, can be rotated through 360 degrees when inserted into a handset or other communications device. A combination of the rotating feature and the pivoting feature of the present invention offers a nearly limitless range of positions for the antenna assembly 300 relative to the communications device to which it is connected.

Figure 20:
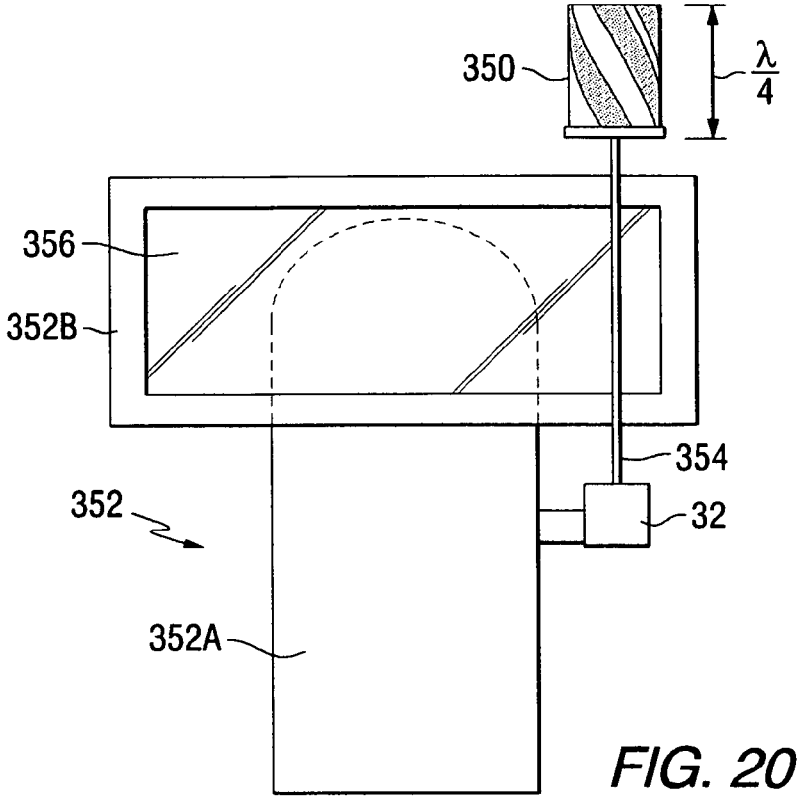
FIG. 20 illustrates a QHA of the present invention for use with a handset communications device further comprising a display.

FIG. 20 depicts a quarter-wavelength quadrifilar helical antenna 350 connected to a handset communications device 352 via a conductor 354. The handset device 352 further comprises a fixed or base member 352A and a movable member 352B, the latter having a first position in a parallel back-to-back orientation relative to the fixed member 352A and a second position in a perpendicular orientation relative to the fixed member 352A. The second position, as illustrated in FIG. 20, reveals a display 356 suitably oriented for viewing multimedia files received by the handset 352. A length of the conductor 354 is determined to accommodate the second position of the rotatable member 352B.

As expected, the quarter-wavelength QHA 350 does not provide the same operating characteristics as the half wavelength QHA 10 described above. In particular, the gain of the antenna 350 is reduced relative to the gain of the QHA 10. In one embodiment, the gain reduction is about 2 dBic.

Figure 21:
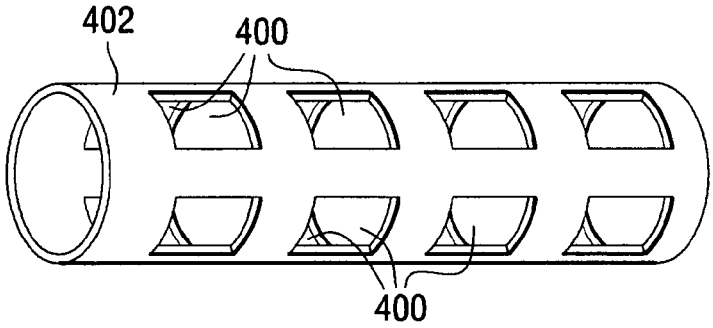
FIGS. 21 and 22 illustrate embodiments of a mandrel for use with a QHA of the present invention.
Figure 22:
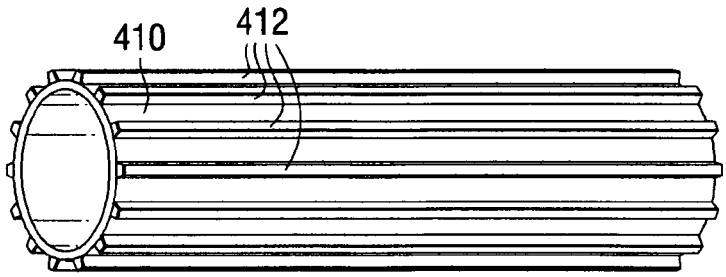

As described above, when an quadrifilar helical antenna of the present invention is operated with a mandrel for dimensional stability, the mandrel dielectrically loads the antenna and thereby changes its performance characteristics. In one embodiment, a plurality of openings 400 are formed in a mandrel 402 as illustrated in FIG. 21 to reduce the mandrel dielectric loading. In another embodiment, a mandrel 410 (see FIG. 22) comprises a plurality of dielectric strips 412 affixed to or formed concurrently with a cylindrical element 414. When the filar substrate 160 of FIG. 10 is disposed about the mandrel 410, an open region 412A between adjacent strips 412 presents an air dielectric to the QHA 10, and thus lowers the dielectric loading of the mandrel 410 on the QHA 10.

In yet another embodiment, a mandrel material comprises a dielectric and the conductive filars 12, 14, 16 and 18 are formed directly thereon. For example, the conductive filars 12, 14, 16 and 18 are formed from conductive material comprising an adhesive rear surface for adhesive attachment to the mandrel. In another embodiment, the filars 12, 14, 16 and 18 are formed of conductive ink applied directly to the mandrel by known printing techniques.

Figure 23:
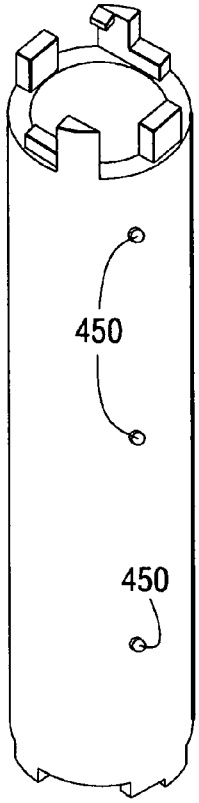
FIGS. 23–25 illustrate structures associated with aligning a mandrel and a substrate of a QHA of the present invention.
Figure 24:
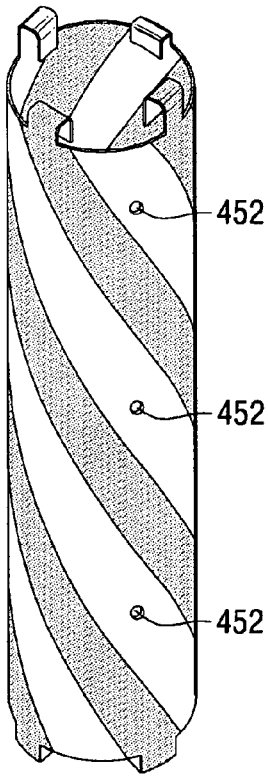
Figure 25:
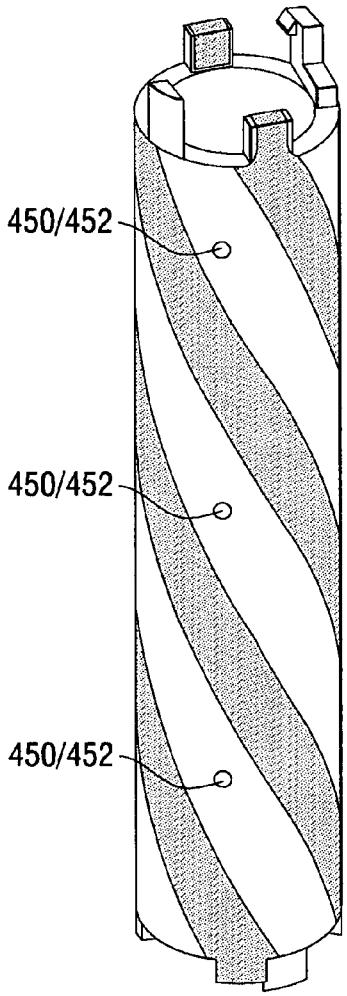

To ensure proper alignment between the mandrel 163 and the substrate 160 (see FIG. 10), according to one embodiment, the mandrel comprises projecting bosses 450 on an outside surface thereof, as illustrated in FIG. 23. The substrate 160 defines corresponding holes or openings 452 as illustrated in FIG. 24. When the substrate 160 is disposed about the mandrel 160, the bosses 450 protrude through the openings 452 to ensure proper alignment between the substrate 160 and the mandrel 163. See FIG. 25.

While the present invention has been described with reference to preferred embodiments, it will be understood by those skilled in the art that various changes may be made and equivalent elements may be substituted for the elements thereof without departing from the scope of the present invention. The scope of the present invention further includes any combination of the elements from the various embodiments set forth herein. In addition, modifications may be made to adapt a particular situation to the teachings of the present invention without departing from its essential scope. Therefore, it is intended that the invention not be limited to the particular embodiments disclosed, but that the invention will include all embodiments falling within the scope of the appended claims.

What is claimed is:

1. A quadrifilar helical antenna, comprising:

a substantially cylindrical substrate defining axially spaced-apart base and end regions;

first and second helical filar segments each having a first length and each defining a first end proximate the base region, the first and the second filar segments extending toward the end region;

second and third helical filar segments each having a second length different than the first length and each defining a first end proximate the base region, the third and the fourth filar segments extending toward the end region; and an impedance matching element disposed proximate the base region and comprising legs extending from a center region, each leg conductively connected to the first end of one of the first, the second, the third and the fourth filar segments, the impedance matching element further comprising a feed terminal in the center region, the impedance matching element for matching an antenna impedance to a source impedance.

2. The antenna of claim 1 further comprising a cylindrical dielectric structure, wherein the substrate comprises a flexible dielectric film disposed about the cylindrical structure, and wherein each one of the first, the second, the third and the fourth filar segments comprises a finger segment extending beyond an edge of the dielectric film such that the finger segments extend beyond a lower edge of the cylindrical structure, and wherein the impedance matching element comprises first, second, third and fourth conductive pads disposed at a terminal end of a respective first, second, third and fourth legs extending from the center region and in electrical communication with impedance matching components disposed on the impedance matching element, and wherein the impedance matching element is mated with the cylindrical structure such that each one of the first, the second, the third and the fourth conductive pads is in conductive communication with the finger segment of one of the first, the second, the third and the fourth filar segments.

3. The antenna of claim 2 wherein a resonant frequency of the antenna is responsive to a thickness of the disk-like structure.

4. The antenna of claim 2 wherein a resonant frequency of the antenna is responsive to a dielectric constant of a material of the disk-like structure.

5. The antenna of claim 2 wherein a material of the first, the second, the third and the fourth conductive pads comprises conductive material having a gold-plated surface.

6. The antenna of claim 2 further comprising finger tabs extending from the lower edge of the cylindrical structure, wherein each one of the finger segments extends over one of the finger tabs, and wherein each one of the finger tabs is received within a corresponding notch defined in the disk-like structure, and wherein each one of the first, the second, the third and the fourth conductive pads of the disk-like structure is urged against one of the finger tabs with the finger segment extending thereover to facilitate conductive communication between each one of the finger segments and one of the first, the second, the third and the fourth conductive pads.

7. The antenna of claim 6 further comprising a projection extending from the cylindrical structure in a direction toward an interior of the cylindrical structure, wherein the projection contacts a bottom surface of the disk-like structure to urge the disk-like structure against the lower edge of the cylindrical structure.

8. The antenna of claim 1 wherein the substrate comprises a dielectric film, and wherein the first, second, third and fourth filar segments are disposed on the dielectric film, and wherein each one of the first, the second, the third and the fourth filar segments comprises a finger segment extending beyond an edge of the dielectric film, and wherein the first and the second filar segments are serially connected through a first conductive element electrically connected between the finger segment of the first filar segment and the finger segment of the second filar segment, and wherein the third and the fourth filar segments are serially connected through a second conductive element electrically connected between the finger segment of the third filar segment and the finger segment of the fourth filar segment.

9. The antenna of claim 8 wherein a length of the finger segment of the first and the second filar segments is substantially identical and different from a length of the finger segment of the third and the fourth filar segments, wherein the length of the finger segment of the third and the fourth filar segments is substantially identical.

10. The antenna of claim 8 wherein the first and the second conductive elements are disposed on a crossbar structure in an insulative relation.

11. The antenna of claim 10 wherein the first and the second conductive elements each comprise a conductive strip disposed in a stacked relation within or on a surface of the crossbar structure, and wherein a resonant frequency of the antenna is responsive to an angle formed between the first and the second conductive strips.

12. The antenna of 10 further comprising a cylindrical dielectric structure, wherein the substrate comprises a flexible dielectric film disposed around the cylindrical structure, and wherein the crossbar structure comprises a disk-like shape having a first, a second, a third and a fourth conductive pad disposed about a circumferential surface thereof, and wherein the first and the second conductive elements are disposed on a surface of or within the crossbar structure, and wherein the first and the second conductive pads are electrically connected by the first conductive element and the third and the fourth conductive pads are electrically connected by the second conductive element, and wherein the crossbar structure is mated with the cylindrical structure such that the first and the second conductive pads are in conductive communication with the finger segment of the first filar segment and the finger segment of the second filar segment, respectively, and wherein the third and the fourth conductive pads are in conductive communication with the finger segment of the third filar segment and the finger segment of the fourth filar segment, respectively.

13. The antenna of claim 12 wherein the cylindrical structure further comprises a projection extending in a direction toward an interior of the cylindrical structure, wherein the projection is in contact with a bottom surface of the crossbar structure to urge the crossbar structure against the lower edge of the cylindrical structure.

14. The antenna of claim 12 wherein a resonant frequency of the antenna is responsive to a thickness of the crossbar structure.

15. The antenna of claim 12 wherein a resonant frequency of the antenna is responsive to a dielectric constant of a material of the crossbar structure.

16. The antenna of claim 12 wherein a material of the first, the second, the third and the fourth conductive pads comprises conductive material having a gold-plated surface.

17. The antenna of claim 12 further comprising finger tabs extending from the lower edge of the cylindrical structure, wherein each one of the finger segments warps about one of the finger tabs, and wherein each one of the finger tabs is received within a corresponding notch defined in the crossbar structure, and wherein each one of the first, the second, the third and the fourth conductive pads of the crossbar structure is urged against one of the finger tabs with the finger segment wrapped thereabout to facilitate conductive communication between each finger segment and one of the first, the second, the third and the fourth conductive pads.

18. The antenna of claim 1 further comprising a cylindrical dielectric structure, wherein the substrate comprises a flexible dielectric film disposed around the cylindrical structure, and wherein the cylindrical structure defines a plurality of openings therein.

19. The antenna of claim 1 further comprising a cylindrical dielectric structure, wherein the substrate comprises a flexible dielectric film, and wherein a plurality of ribs are disposed on an external surface of the cylindrical structure, and wherein the flexible dielectric film is disposed around the cylindrical structure adjacent the plurality of axial ribs.

20. The antenna of claim 1 further comprising a cylindrical dielectric structure, wherein the substrate comprises a flexible dielectric film, and wherein a material having a lower dielectric constant than a material of the cylindrical structure is interposed between the cylindrical structure and the dielectric film.

21. The antenna of claim 1 further comprising a cylindrical dielectric structure, wherein the substrate comprises a flexible dielectric film, and wherein the flexible dielectric film defines a plurality of openings therein and an external surface of the cylindrical structure comprises a plurality of corresponding protrusions for receiving one of the plurality of openings.

22. The antenna of claim 1 further comprising a connector in electrical communication with the center region of the impedance matching element, wherein an open electrical terminal of the connector is adapted for connection to a communications device operative with the quadrifilar helical antenna.

23. The antenna of claim 22 wherein the connector is disposed underlying and spaced apart from the impedance matching element, and wherein a length of a conductor electrically connects the connector and the impedance matching element.

24. The antenna of claim 23 wherein the conductor comprises a coaxial cable.

25. The antenna of claim 23 the conductor comprises a shock-absorbing length of conductive material.

26. The antenna of claim 23 wherein the conductor is substantially surrounded by a flexible sleeve.

27. The antenna of claim 23 wherein the conductor is substantially surrounded by an over-molded element extending between the impedance matching element and the connector.

28. The antenna of claim 23 wherein a portion of the length of the conductor is substantially surrounded by an over-molded element.

29. The antenna of claim 1 wherein the first, second, third and fourth filar segments are substantially surrounded by a cover, the antenna further comprising a connector in electrical communication with and physically underlying the impedance matching element, wherein an open electrical terminal of the connector is adapted for connection to a communications device operative with the antenna, and wherein the connector is pivotally joined to the cover to permit adjustment of an angle formed between the cover and the connector.

30. The antenna of claim 29 wherein the open electrical terminal forms a rotatable joint with the communications device permitting rotation of the antenna with respect to the communications device.

31. The quadrifilar helical antenna of claim 1 wherein the first length is longer than a resonant length at a resonant frequency and the second length is shorter than the resonant length at the resonant frequency.

32. The quadrifilar helical antenna of claim 1 wherein the impedance matching element creates a quadrature phase relationship for signals propagating on the first, second, third and fourth filar segments.

33. A handset communications device comprising:

a base;

a cover movably engaged with the base for manipulation into different orientations with respect to the base;

a quadrifilar helical antenna disposed in the base, the antenna comprising:

a substantially cylindrical substrate;

a first, a second, a third and a fourth helical filar disposed on the substrate, wherein at least two of the first, the second, the third and the fourth filars have a different length;

an impedance matching element conductively connected to the first, second, third and fourth filars for matching an antenna impedance to a source impedance; and a connector disposed between the impedance matching element and the base.

34. The antenna of claim 33 further comprising a conductive element extending between and electrically connecting the connector and the impedance matching element, wherein a length of the conductive element is determined to accommodate the different orientations of the cover with respect to the base.

35. The antenna of claim 33 further comprising a cover substantially surrounding the cylindrical substrate, wherein the connector forms a pivoting joint with the cover to adjust an angle formed between the cover and the connector.

36. The antenna of claim 33 wherein the connector forms a rotatable joint with the base to permit rotation of the antenna relative to the base.

37. The quadrifilar helical antenna of claim 33 further comprising a first conductive element for forming a first helical conductor by serially connecting the first and the second helical filars and a second conductive element for forming a second helical conductor by serially connecting the third and the fourth helical filars, and wherein a length of the first helical conductor is different than a length of the second helical conductor.

* * * * *